US012281449B2

(12) United States Patent
Wulf

(10) Patent No.: US 12,281,449 B2
(45) Date of Patent: Apr. 22, 2025

(54) PAVING MACHINE HAVING HYDRAULIC FLOW TUBES

(71) Applicant: GOMACO Corporation, Ida Grove, IA (US)

(72) Inventor: Jason D Wulf, Odebolt, IA (US)

(73) Assignee: GOMACO Corporation, Ida Grove, IA (US)

( * ) Notice: Subject to any disclaimer, the term of this patent is extended or adjusted under 35 U.S.C. 154(b) by 743 days.

(21) Appl. No.: 17/566,354

(22) Filed: Dec. 30, 2021

(65) Prior Publication Data

US 2023/0212830 A1 Jul. 6, 2023

(51) Int. Cl.

| | |
|---|---|
| ***E01C 19/48*** | (2006.01) |
| ***E01C 19/00*** | (2006.01) |
| ***E01C 19/42*** | (2006.01) |

(52) U.S. Cl.

CPC ..... *E01C 19/004* (2013.01); *E01C 19/002* (2013.01); *E01C 19/42* (2013.01); *E01C 19/4873* (2013.01); *E01C 19/4893* (2013.01); *E01C 2301/18* (2013.01)

(58) Field of Classification Search

CPC .... E01C 19/30; E01C 19/484; E01C 19/4853; E01C 19/4886; E01C 19/4893; E01C 19/506

See application file for complete search history.

(56) References Cited

U.S. PATENT DOCUMENTS

| | | | | |
|---|---|---|---|---|
| 3,318,199 A | | 5/1967 | Parrett | |
| 3,665,821 A | * | 5/1972 | Walker | E01C 19/4893 404/113 |
| 3,749,505 A | * | 7/1973 | Miller | B62D 55/116 404/98 |
| 4,076,474 A | * | 2/1978 | Catenacci | B28B 1/084 425/84 |
| 4,152,382 A | * | 5/1979 | Catenacci | B28B 1/084 264/33 |
| 4,391,549 A | * | 7/1983 | Murray | E01C 19/4893 404/98 |
| 5,035,534 A | * | 7/1991 | Brock | E01C 19/48 404/81 |

(Continued)

OTHER PUBLICATIONS

Custom Actuator Products, Inc., "'Smart' Mini Cylinders With .001" Repeatability", Compact Hydraulic Cylinders, Downloaded Dec. 17, 2021, 16 pages.

(Continued)

*Primary Examiner* — Gary S Hartmann

(74) *Attorney, Agent, or Firm* — Suiter Swantz IP

(57) ABSTRACT

A paving machine includes a mold coupled to a telescopic frame member, by which the mold side-shifts relative to a main frame. A tight clearance between the paving machine and a surface being paved may be achieved by the ability to side-shift the mold. The paving machine may also include a number of vibrator motors. A flow to the vibrator motors may be controllable by a manifold controller. The manifold controller is located on an end of the telescopic frame member. By locating the manifold controller on the telescopic frame member, an operator of the paving machine may both stand on the telescopic frame member to watch the paving mold and adjust the settings of the vibrator controller.

20 Claims, 14 Drawing Sheets

(56) References Cited

U.S. PATENT DOCUMENTS

| | | | | |
|---|---|---|---|---|
| 5,533,888 | A * | 7/1996 | Belarde | E01C 19/008 425/432 |
| 5,616,291 | A | 4/1997 | Belarde | |
| 6,109,825 | A * | 8/2000 | Yon | E01C 19/008 404/84.2 |
| 6,450,048 | B1 | 9/2002 | Samuelson et al. | |
| 9,764,762 | B2 | 9/2017 | Klein et al. | |
| 10,501,913 | B2 | 12/2019 | Schaeding | |
| 10,940,883 | B2 | 3/2021 | Schaeding et al. | |
| 11,008,714 | B2 * | 5/2021 | Cooper | B28B 1/084 |
| 11,149,388 | B1 | 10/2021 | Pedersen et al. | |
| 12,060,685 | B2 * | 8/2024 | Cooper | E01C 19/4886 |
| 2003/0180092 | A1 * | 9/2003 | Piccoli | E01C 19/4893 404/98 |
| 2015/0093193 | A1 | 4/2015 | Zimmermann et al. | |
| 2017/0107674 | A1 | 4/2017 | Pedersen et al. | |
| 2021/0114655 | A1 | 4/2021 | Farr et al. | |
| 2022/0389666 | A1 * | 12/2022 | Farr | E01C 23/04 |
| 2024/0011228 | A1 * | 1/2024 | Boere | E03F 3/046 |

OTHER PUBLICATIONS

Gomaco, GT 3600 Brochure, Downloaded Dec. 17, 2021, 24 pages.

* cited by examiner

100

200

Section View A-A

PAVING MACHINE HAVING HYDRAULIC FLOW TUBES

TECHNICAL FIELD

Embodiments of the invention are directed generally toward the field of paving operations, and more particularly for arrangements of side-shiftable paving molds.

BACKGROUND

Paving machines include a number of components which are controlled by hydraulic fluid. Typically, the hydraulic fluid is provided to the components of the paving machine by hydraulic hose. The hydraulic hose fluidically couples the components to a hydraulic power supply. The hydraulic power supply is commonly coupled to a main frame of the paving machine. In some instances, the components are moveable relative to the main frame. Such movement of the components causes similar movement of the hydraulic hose. Thus, a routing path of the hydraulic hose provides a limiting factor in component placement on the paving machine. In particular, the hydraulic hose may not be routed safely through telescopic portions of the paving machine without damage to the hose or exceeding manufacturer recommended bend radius.

Therefore, it would be advantageous to provide one or more of a device, system, or method that cures the shortcomings described above.

SUMMARY

Embodiments of the present disclosure are directed to a paving machine. In one embodiment, the paving machine includes a frame adapted to move in a paving direction. In another embodiment, the frame includes a hydraulic power supply coupled to the frame. In another embodiment, the paving machine includes a frame member configured to telescope relative to the frame. In another embodiment, the paving machine includes a slipform mold including a profile for forming a material into shape when the frame is moved in the paving direction. The slipform mold is coupled to the frame member for side-shifting the slipform mold relative to the frame. In another embodiment, the paving machine includes vibrator motors configured to vibrate the material for consolidating the material. The vibrator motors are configured to vibrate in response to receiving a flow of hydraulic fluid from the hydraulic power supply. In another embodiment, the paving machine includes a manifold assembly including a vibrator inlet manifold, a vibrator outlet manifold, and a manifold controller. The vibrator control manifold is configured to control the flow of hydraulic fluid to the plurality of vibrator motors based on an electrical signal from the manifold controller. The manifold assembly is coupled to the frame member for providing operator access to the manifold controller from the frame member.

Embodiments of the present disclosure are directed to a hydraulic circuit of a paving machine. In one embodiment, the hydraulic circuit includes a hydraulic reservoir configured to hold a hydraulic fluid. In another embodiment, the hydraulic circuit includes a hydraulic pump connected to the hydraulic reservoir. The hydraulic pump is configured to supply a flow of the hydraulic fluid from the hydraulic reservoir. In another embodiment, the hydraulic circuit includes a hydraulic subcircuit. In another embodiment, the hydraulic subcircuit includes hydraulic motors configured to engage in response to receiving the flow of hydraulic fluid from the hydraulic pump. In another embodiment, the hydraulic subcircuit includes an inlet manifold. The inlet manifold is configured to control the flow of hydraulic fluid to the plurality of hydraulic motors based on an electrical signal from a manifold controller. In another embodiment, the hydraulic subcircuit includes an outlet manifold. In another embodiment, the hydraulic circuit includes a first telescopic fluid line providing a flow path between the hydraulic pump and the inlet manifold. In another embodiment, the hydraulic circuit includes a second telescopic fluid line providing a flow path between the outlet manifold and the hydraulic reservoir.

Further Contemplations:

Embodiments of the present disclosure are directed to a telescopic fluid line. In one embodiment, the telescopic fluid line includes a case weldment. In another embodiment, the case weldment includes a first pipe including a first end and a second end. In another embodiment, the case weldment includes a first cap member coupled to the first end of the first pipe, the first cap member including a first port. In another embodiment, the case weldment includes a second cap member coupled to the second end of the first pipe, the second cap member including a recess. In another embodiment, the telescopic fluid line includes a rod seal received within the recess of the second cap member. In another embodiment, the telescopic fluid line includes a second pipe including a second port. The second pipe is received within the second cap member and within the first pipe by way of the second end. The second pipe is configured to translate relative to the first pipe for providing an adjustable length flow path for a hydraulic fluid between the first port and the second port by way of the first pipe and the second pipe. The rod seal surrounds an outer diameter of the second pipe to provide a seal for the hydraulic fluid between the second cap member and the second pipe.

Embodiments of the present disclosure are directed to a paving machine. In one embodiment, the paving machine includes a frame adapted to move in a paving direction. In another embodiment, the frame includes a hydraulic power supply coupled to the frame. In another embodiment, the paving machine includes a trimmer mount assembly coupled to the frame. In another embodiment, the trimmer mount assembly includes a vertical mount coupling the trimmer mount assembly to the frame. In another embodiment, the trimmer mount assembly includes an adapter plate coupled to the vertical mount. In another embodiment, the trimmer mount assembly includes at least one frame rail configured to telescope relative to the adapter plate. In another embodiment, the trimmer mount assembly includes at least one telescopic fluid line coupled to both the adapter plate and the frame rails. In another embodiment, the paving machine includes a trimmer sub-circuit coupled to the trimmer mount assembly. In another embodiment, the trimmer sub-circuit is configured to trim a subgrade of a surface in response to receiving hydraulic fluid from the hydraulic power supply. In another embodiment, the at least one telescopic fluid line provides a telescopic flow path for the hydraulic fluid between the hydraulic power supply and the trimmer sub-circuit.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION OF EXEMPLARY EMBODIMENTS

Figure 1A:
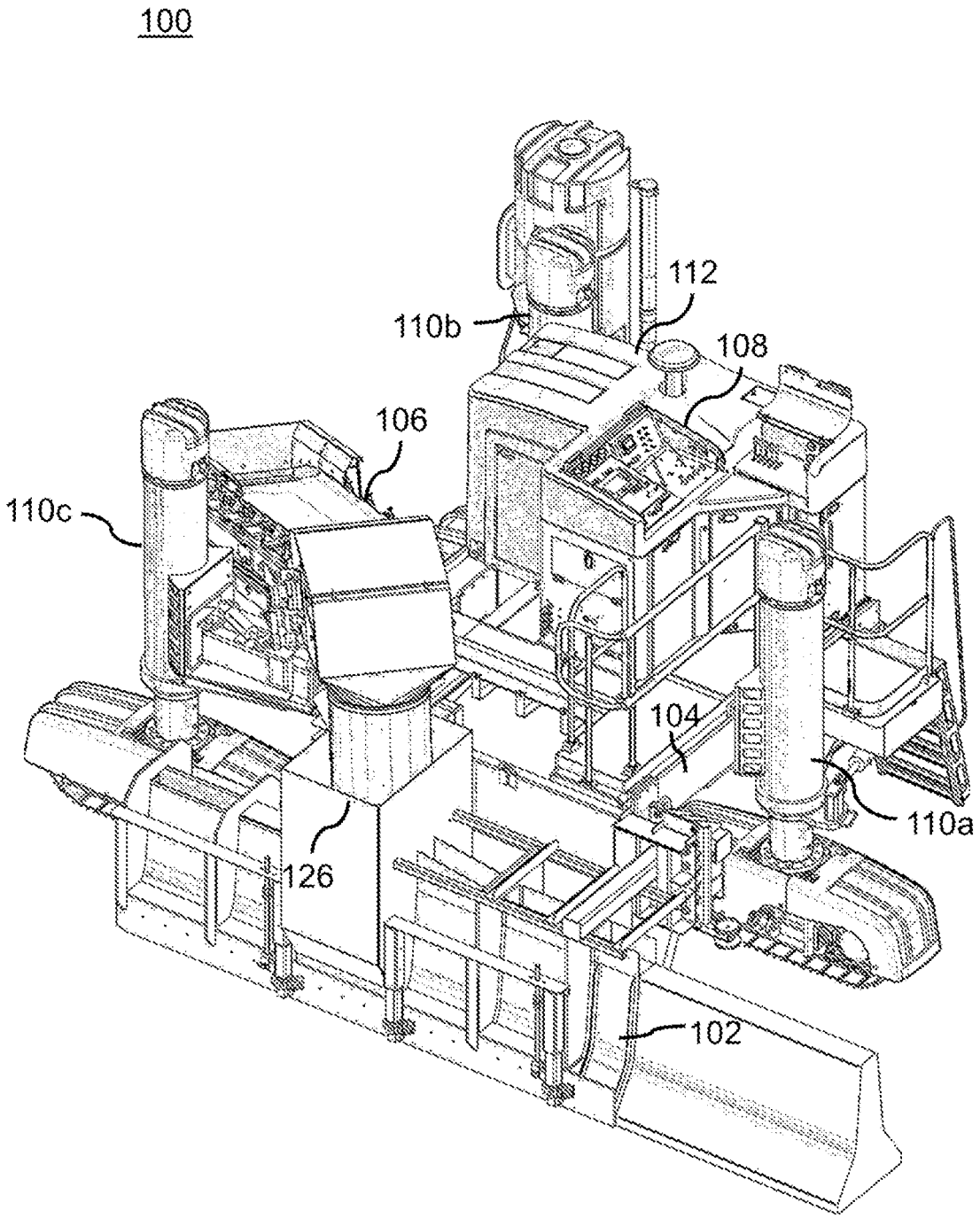
FIG. 1A depicts a rear perspective view of a paving machine, in accordance with one or more embodiments of the present disclosure.
Figure 1B:
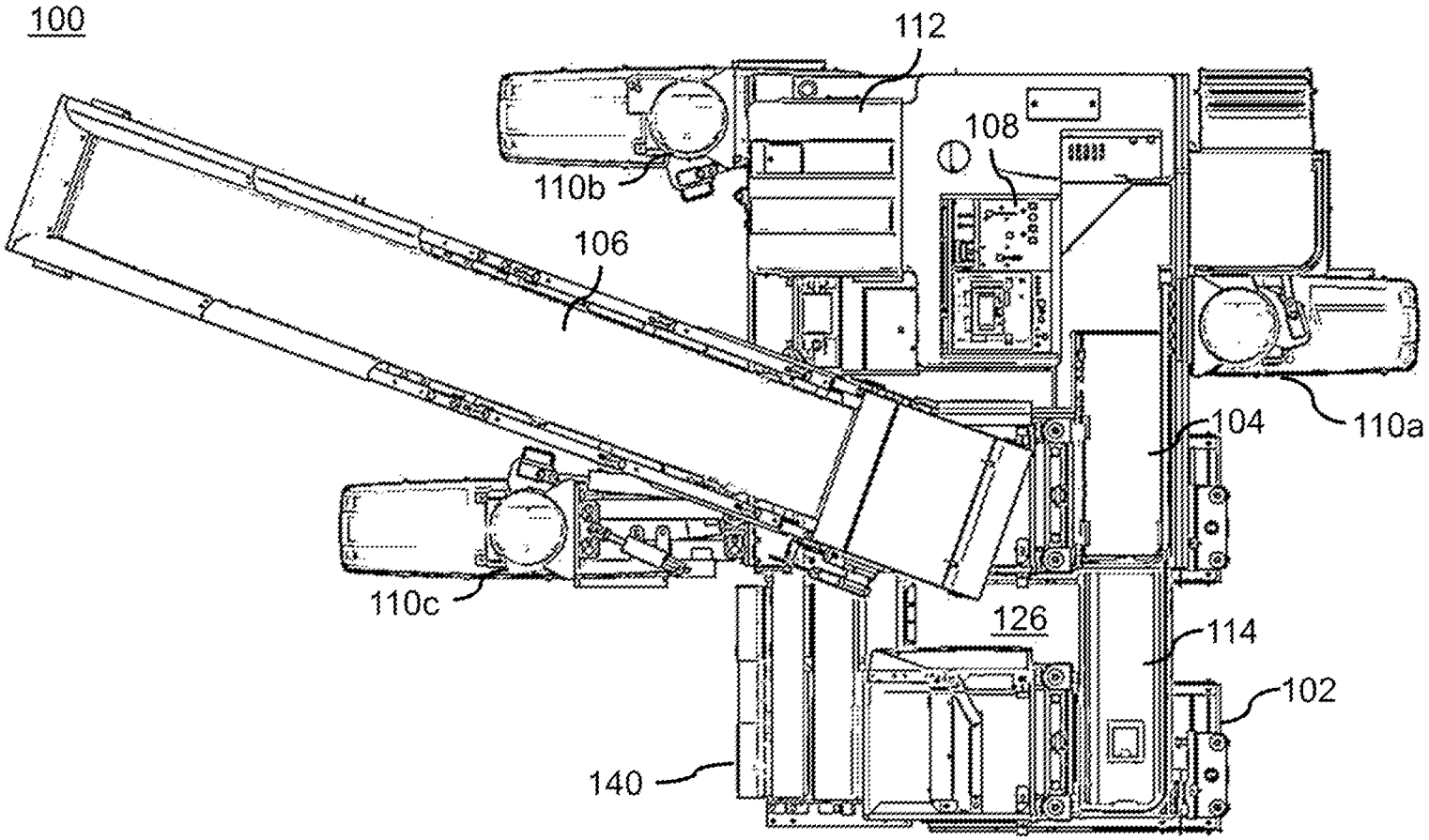
FIG. 1B depicts a top plan view of a paving machine, in accordance with one or more embodiments of the present disclosure.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive "or". For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination or sub-combination of two or more such features, along with any other features which may not necessarily be expressly described or inherently present in the instant disclosure.

Reference will now be made in detail to the subject matter disclosed, which is illustrated in the accompanying drawings. Referring generally to FIGS. 1A-1H, a paving machine 100 is described, in accordance with one or more embodiments of the present disclosure. The paving machine 100 may include a number of components, such as, but not limited to, a slipform mold 102, frame 104, a conveyor 106, a control system 108, a height adjustable leg assembly 110, a hydraulic power supply 112, a frame member 114, a hopper 126, or a trimmer-head 140. A number of such components may be coupled to the frame 104 or the frame member 114.

The height adjustable leg assemblies 110 may be coupled to the frame 104. By the height adjustable leg assemblies 110, the frame 104 may be adapted to move in a paving direction. In this regard, the height adjustable leg assembly may include one or more crawlers, track assemblies, or wheel assemblies which propel the frame 104. The height adjustable leg assembly 110 may include any height adjustable leg assembly known in the art. For example, the height adjustable leg assembly 110 may be similar to a leg assembly described in U.S. Pat. No. 9,764,762, titled ROTARY PIVOT ARM POSITIONING ASSEMBLY, which is incorporated herein by reference in the entirety. By way of another example, the height adjustable leg assembly 110 may be similar to a leg assembly described in U.S. patent application Ser. No. 17/336,863, titled LEG ASSEMBLY FOR CONSTRUCTION MACHINE, which is incorporated herein by reference in the entirety. A number of height adjustable leg assemblies 110 may be coupled to the frame, such as two, three (as depicted), or four of the height adjustable leg assemblies. Said height adjustable leg assembly 110 may be coupled to the frame 104 in a number of manners. For example, a height adjustable leg assembly

Figure 1C:
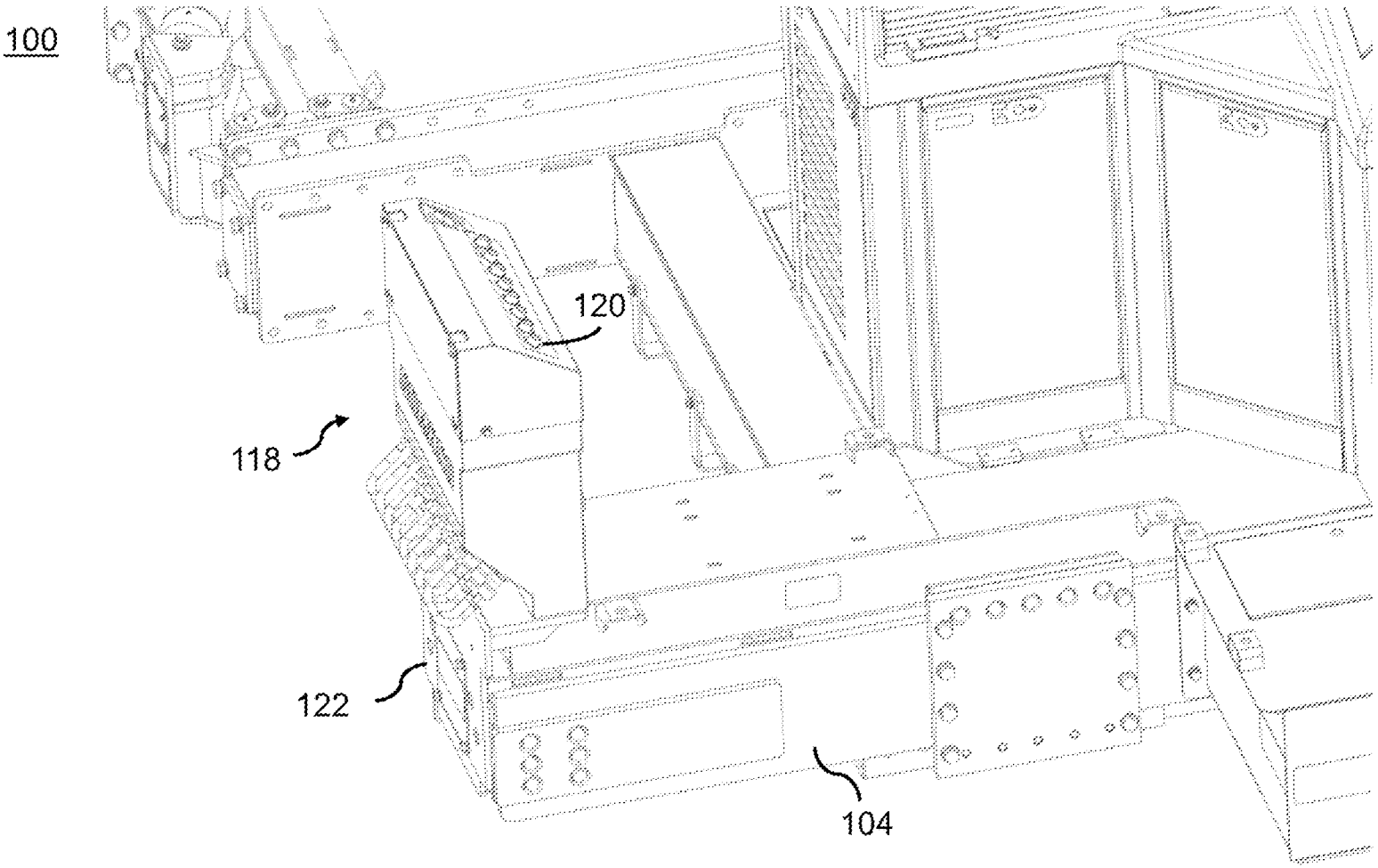
FIGS. 1C-1D depicts a partial perspective view of a manifold assembly coupled to a frame member of a paving machine, in accordance with one or more embodiments of the present disclosure.
Figure 1D:
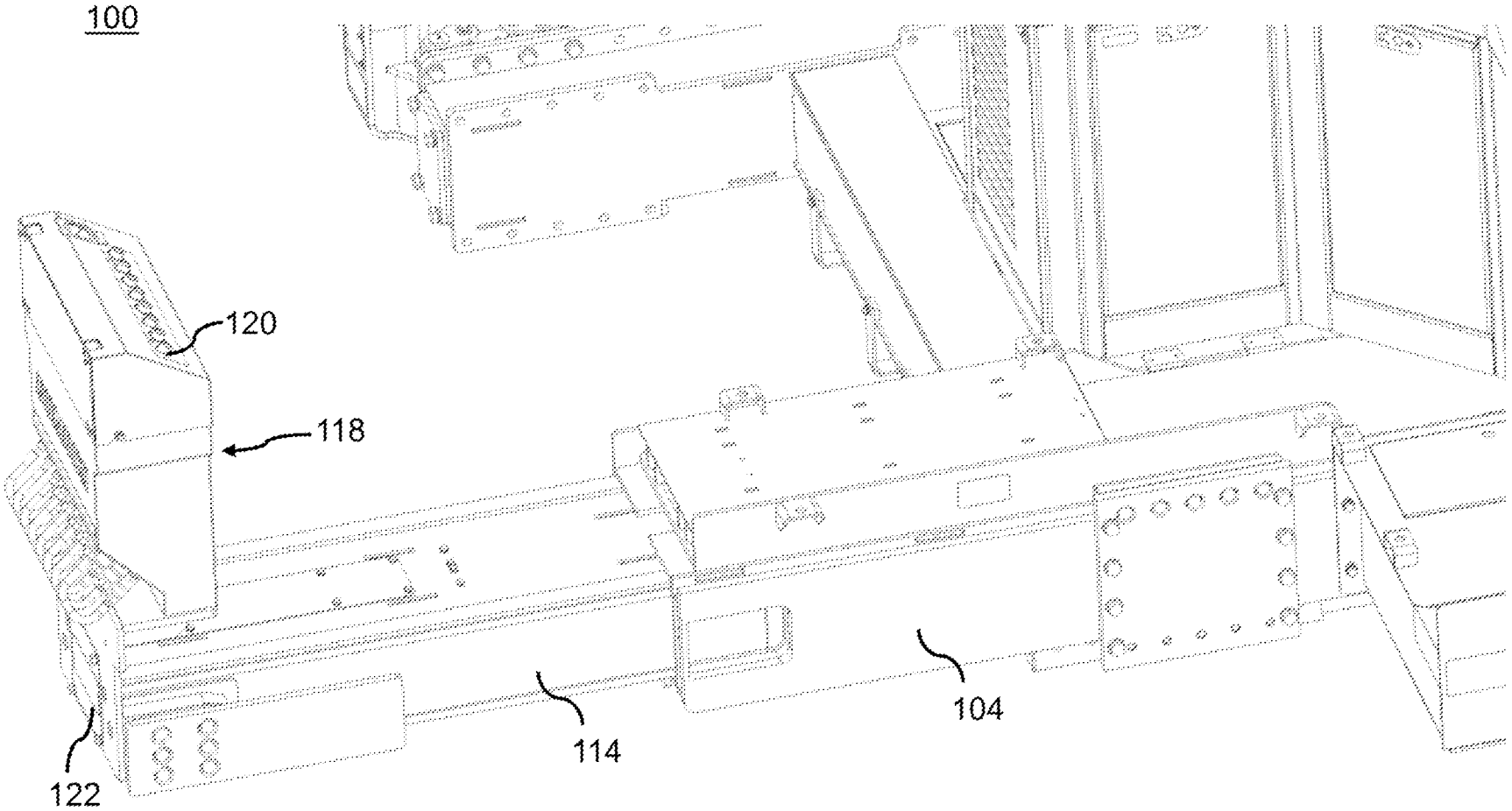
Figure 1E:
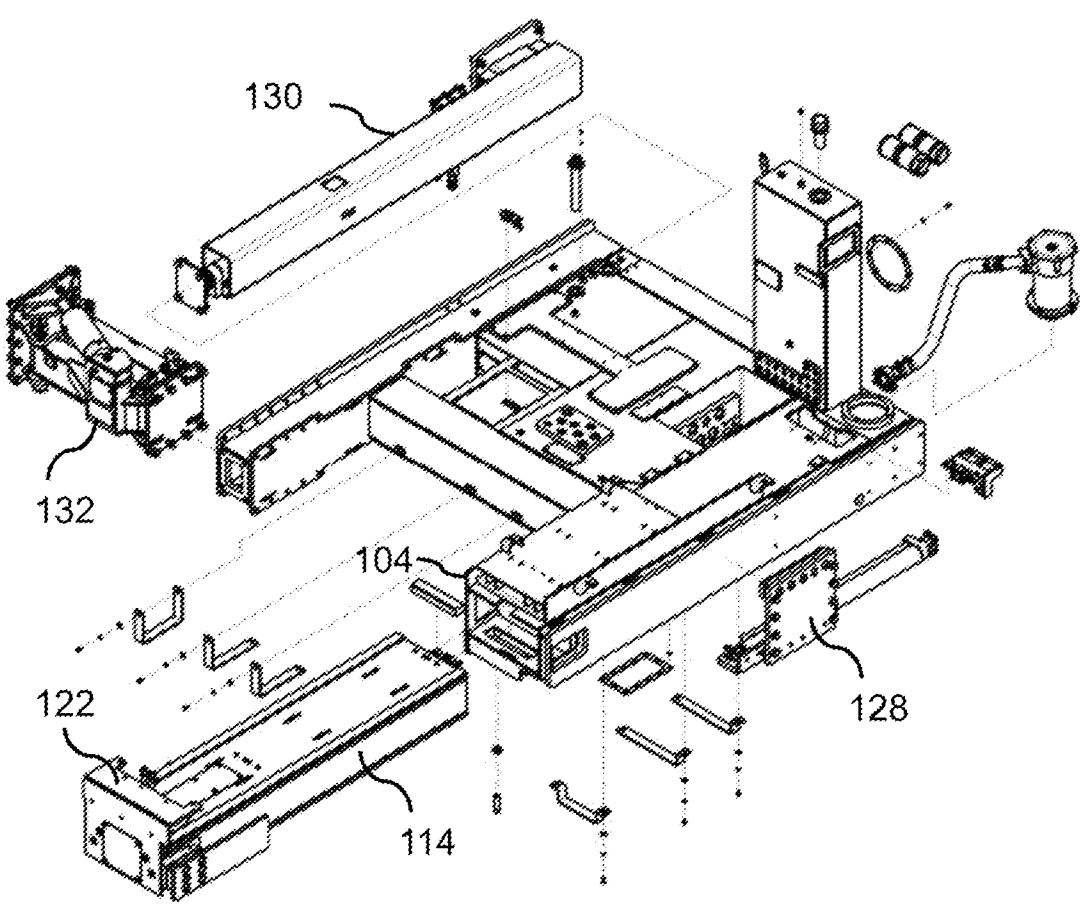
FIG. 1E depicts a partial exploded view of a paving machine, in accordance with one or more embodiments of the present disclosure.

110*a* may be coupled to the frame 104 by a power-slide coupling 128 (see FIG. 1E). By way of another example, a height adjustable leg assembly 110*b* may be coupled to the frame 104 by a telescopic coupling 130 (see FIG. 1E). By way of another example, a height adjustable leg assembly 110*c* may be coupled to the frame 104 by a pivoting coupling 132 (see FIG. 1E). It is further contemplated that any number of the height adjustable leg assembly 110 may be coupled to the frame 104 by a number of permutations of a direct coupling (e.g., fixed attachment), the power-slide coupling 128, the telescopic coupling 130, or the pivot arm coupling 132, as is known in the art.

The hydraulic power supply 112 may be connected to the frame 104. The hydraulic power supply 112 may include a number of components, such as, but not limited to, a power source, a hydraulic reservoir (for holding a hydraulic fluid), a hydraulic pump, a filter, a cooler, or a heater. The power source may include any power source configured to generate power known in the art, such as, but not limited to, a gasoline engine, a diesel engine, or an electric power source of various sizes and power ratings. The hydraulic power supply 112 may be then configured to pump hydraulic fluid from the hydraulic reservoir by the hydraulic pump and the supply a flow (e.g., hydraulic power) of the hydraulic fluid to one or more hydraulic components of the paving machine 100.

The conveyor 106 may be connected to the frame 104. The conveyor 106 may convey a concrete material to the slipform mold 102. In some instances, the conveyor 106 conveys the material to the slipform mold 102 by way of the hopper 126. The conveyor 106 may include any suitable conveyor, such as, but not limited to, a belt conveyor or an auger conveyor. Although the paving machine 100 is described and depicted as including the conveyor 106 and the hopper 126, this is not intended as a limitation on the present disclosure. In this regard, the concrete material may be provided ahead of the slipform mold 102 (e.g., by a placer/spreader machine), as is known in the art.

The slipform mold 102 may be coupled to the frame member 114. By the coupling, the slipform mold 102 may be moved in a direction of travel for forming a material into shape. For example, the height adjustable leg assemblies 110 may propel the frame 104, the frame member 114, and similarly the slipform mold 102 in the direction of travel. Thus, the slipform mold 102 may perform paving operations in a left-hand or a right-hand pave configuration for providing relatively small width paving operations (e.g., curb and gutter paving, barrier paving, etc.). It is contemplated that the slipform mold 102 may be coupled to the frame member 114 in a number of manners, such as, but not limited to, a hook-and-go attachment, a bolted attachment, or another method known in the art. In some embodiments, the slipform mold 102 may include a profile for forming a concrete material into a shape. A number of profiles for such slipform mold 102 are contemplated, such as, but not limited to, a curb including an integral gutter, a median barrier, a sidewalk, a drainage canal, or another suitable profile.

In some embodiments, the frame member 114 may be configured to telescope relative to the frame 104. The frame member 114 may telescope relative to the frame 104 by a hydraulic cylinder 116 (see FIG. 1F, for example). One or more of the frame 104 or the frame member 114 may further include a component to reduce wear between the frame 104 and the frame member 114, such as, but not limited to, a wear pad or a roller bearing. By the telescopic action of the frame member 114, the slipform mold 102 may be side-shifted relative to the frame 104 and similarly relative to the height adjustable leg assemblies 110. The ability to side-shift the slipform mold 102 is advantageous in achieving a tight clearance between the height adjustable leg assemblies 110 (in particular the crawler tracks) of the paving machine and a concrete surface being paved. Furthermore, the ability to side-shift may provide flexibility depending upon a type of profile being formed. The cylinder 116 may include a stroke suitable for telescoping the frame member 114 relative to the frame 104. For example, the frame member 114 may be telescoped by up to 48 inches or more, relative to the frame 104.

The control system 108 may also be coupled to the frame 104. The control system 108 may be configured to selectively control a number of components of the paving machine 100, such as controlling the components during paving operations or transport operations. For example, the control system 108 may perform methods described in U.S. Pat. No. 10,501,913, titled COORDINATED AND PROPORTIONAL GRADE AND SLOPE CONTROL USING GAIN MATRIXES, which is incorporated herein by reference in the entirety. By way of another example, the control system 108 may perform methods described in U.S. Pat. No. 10,940,883, titled FREESTEERING SYSTEM FOR MOBILE MACHINES, which is incorporated herein by reference in the entirety. By way of another example, the control system 108 may perform methods described in U.S. patent application Ser. No. 15/873,206, Publication No. 2021/0114655, titled Paving Machine with Smart Steering Control, which is incorporated herein by reference in the entirety. By way of another example, the control system 108 may perform methods described in U.S. Pat. No. 11,149,388, titled SLEW DRIVE CONTROL, which is incorporated herein by reference in the entirety. In some embodiments, the control system 108 is configured to cause the frame member 114 to telescope relative to the frame 104. For example, the control system 108 may provide electrical signals to one or more hydraulic subcircuits controlling the hydraulic cylinder 116.

The control system 108 may consist of a mobile machine control computer, a desktop computer, mainframe computer system, workstation, parallel processor, or other computer system configured to execute a program configured to operate the paving machine 100, as described throughout the present disclosure. In this regard, the control system 108 may generally include a processor and a memory. The processor may include any device configured to execute algorithms and/or instructions (e.g., program instructions stored in memory). For the purposes of the present disclosure, the term "processor" or "processing element" may be broadly defined to encompass any device having one or more processing or logic elements (e.g., one or more microprocessor devices, one or more application specific integrated circuit (ASIC) devices, one or more field programmable gate arrays (FPGAs), or one or more digital signal processors (DSPs)). Similarly, the memory may include any storage medium known in the art suitable for storing program instructions executable by the processor. For example, the memory may include a non-transitory memory medium such as, but not limited to, a read-only memory (ROM), a random-access memory (RAM), a solid-state drive, and the like. It is further noted that memory may be housed in a common controller housing with the processor. The processor may be configured to receive the various information from the sensors by one or more controller area network buses.

The slipform paver may further include a number of vibrators. The vibrators may vibrate the concrete material for consolidating air out of the material. The vibrators may be disposed in a number of locations for providing such vibration. For example, the vibrators may be coupled to the slipform mold 102, for causing the slipform mold 102 to vibrate the material. By way of another example, the vibrators may be disposed within the hopper 126, for vibrating the material prior to the material being formed into shape by the slipform mold 102. Thus, the vibrators are coupled to the frame member 114 by way of the pan, the hopper 126, or slipform mold 102. By the coupling, the vibrators may also side-shift with the frame member 114. The vibrators may generally include any vibrators known in the art, such as, but not limited to, immersion vibrators (also known as needle vibrators, bent pipe vibrator), external vibrators (also known as shutter vibrator or formwork vibrator), or surface vibrators (also known as pan vibrators). The vibrators may include a vibrator motor which is fluidically coupled to the hydraulic power supply 112 and causes vibration in response to receiving fluid from the hydraulic power supply. The paving machine 100 may generally include pairs of hydraulic vibrators, such as, but not limited to two vibrators, four vibrators, six vibrators, eight vibrators, or more. The vibrators may include a range of vibrational frequencies between which the vibrators may be controlled. For example, a vibrational frequency of the vibrators may be selectively controllable between zero and ten-thousand vibrations per minute, or more.

Referring now in particular to FIGS. 1C-1D, the paving machine 100 includes a manifold assembly 118. The manifold assembly is configured to control a flow rate of hydraulic fluid to one or more components of the paving machine 100. For example, the manifold assembly 118 may be configured to control a flow of the hydraulic fluid to one or more vibrator motors. The manifold assembly 118 may include a number of hydraulic components, such as, but not limited to a manifold controller 120, an inlet manifold, and an outlet manifold. The manifold controller 120 may be configured to supply an electrical signal to the inlet manifold, for selectively controlling the flow rate of the hydraulic fluid to the vibrator motors, thereby controlling the vibrational frequency of the vibrators. The inlet manifold and the outlet manifold may each include at least as many valves as the number of vibrators (e.g., two to eight, or more). Similarly, the manifold controller 120 may include a number of dials, switches, touchscreen controls, or the like for controlling valve of the manifold.

In some embodiments, the manifold assembly 118 may be coupled to the frame member 114. By coupling the manifold assembly 118 to the frame member 114, the manifold assembly 118 may be accessible by an operator standing on the frame member 114. In this regard, the operator may stand on the frame member 114 to watch as the concrete material is formed into shape by the slipform mold 102 and consolidated by the vibrators. The operator may also adjust one or more settings (e.g., a vibration rate) of the manifold assembly 118 while standing on the frame member 114. The ability to adjust the vibration rate of the vibrators without having to walk to the control system 108 is extremely advantageous in ensuring adequate consolidation of the concrete material. In this regard, the operator may control the vibration rate using visual feedback.

In some embodiments, the manifold assembly 118 is coupled to an end of the frame member 114. For example, the manifold assembly 118 may be adapted to couple to the end of the frame member 114 by an adapter plate 122. The adapter plate 122 may include an L-shaped adapter plate, with a first face attached to the end of the frame member 114 and a second face attached to the manifold assembly 118. It is further contemplated that the manifold assembly 118 may be coupled to the frame member 114 by a direct attachment. It is further contemplated that the manifold assembly 118 may be coupled inward from the end of the frame member 114. However, coupling the manifold assembly 118 to the end of the frame member 114 may be advantageous in maximizing a length by which the frame member 114 may telescope relative to the frame 104. In this regard, by the presently depicted configuration in FIGS. 1C and 1D, the frame member 114 may be retracted within the frame 104 for a full stroke, with the manifold assembly 120 being disposed above the frame 104.

In some instances, the manifold assembly 118 is fluidically coupled to the hydraulic power supply 112 by one or more hydraulic hoses. For example, the hydraulic hoses may be disposed outside of the frame 104 and the frame member 114. However, such arrangement of the hydraulic hoses may provide a tripping hazard for the operator. By way of another example, the hydraulic hoses may be disposed within the frame 104 and the frame member 114, for reducing a tripping hazard associated with the hoses. However, the internal dimensions of the frame member 114 together with the telescopic motion of the frame member 114 relative to the frame 104, may induce pinching of the hydraulic hoses. Furthermore, the hydraulic hoses may fail to comply with a minimum recommended bend radius (e.g., causing hose kinking) when disposed within the frame 104 and the frame member 114.

Figure 1F:
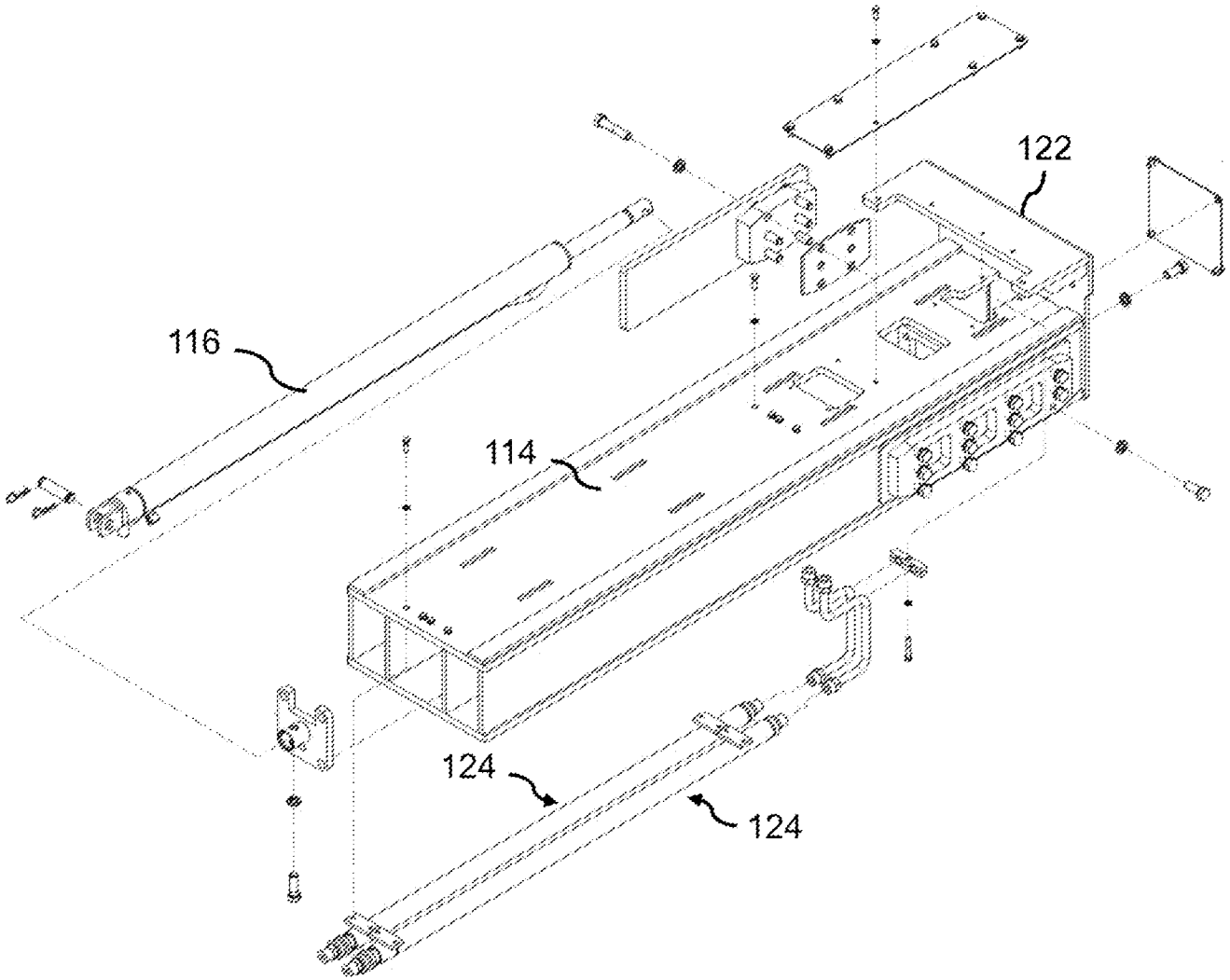
FIG. 1F depicts a partial exploded view of a paving machine, in accordance with one or more embodiments of the present disclosure.
Figure 1G:
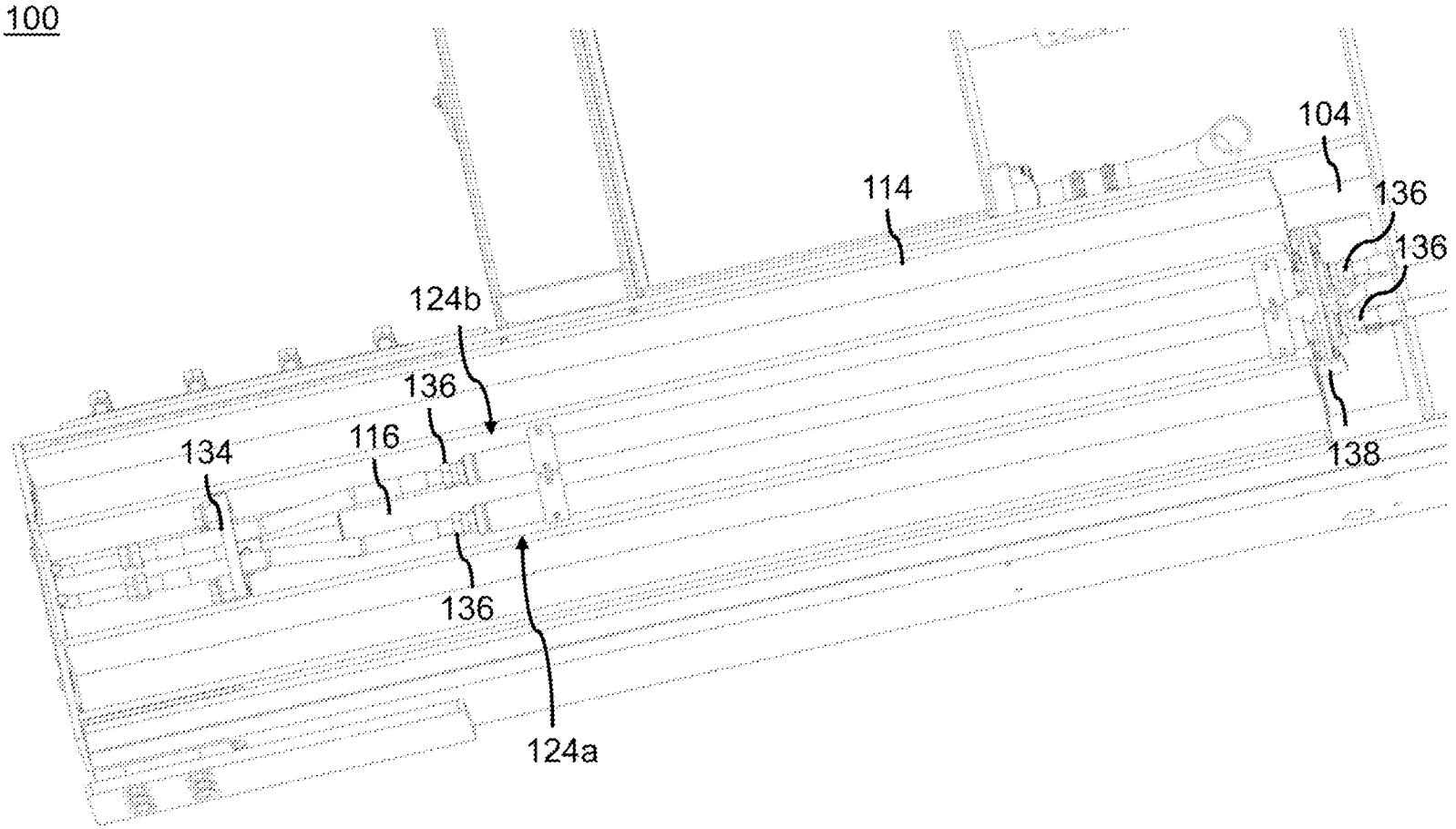
FIGS. 1G-1H depicts a section view showing telescopic fluid lines within a frame member of a paving machine, in accordance with one or more embodiments of the present disclosure.
Figure 1H:
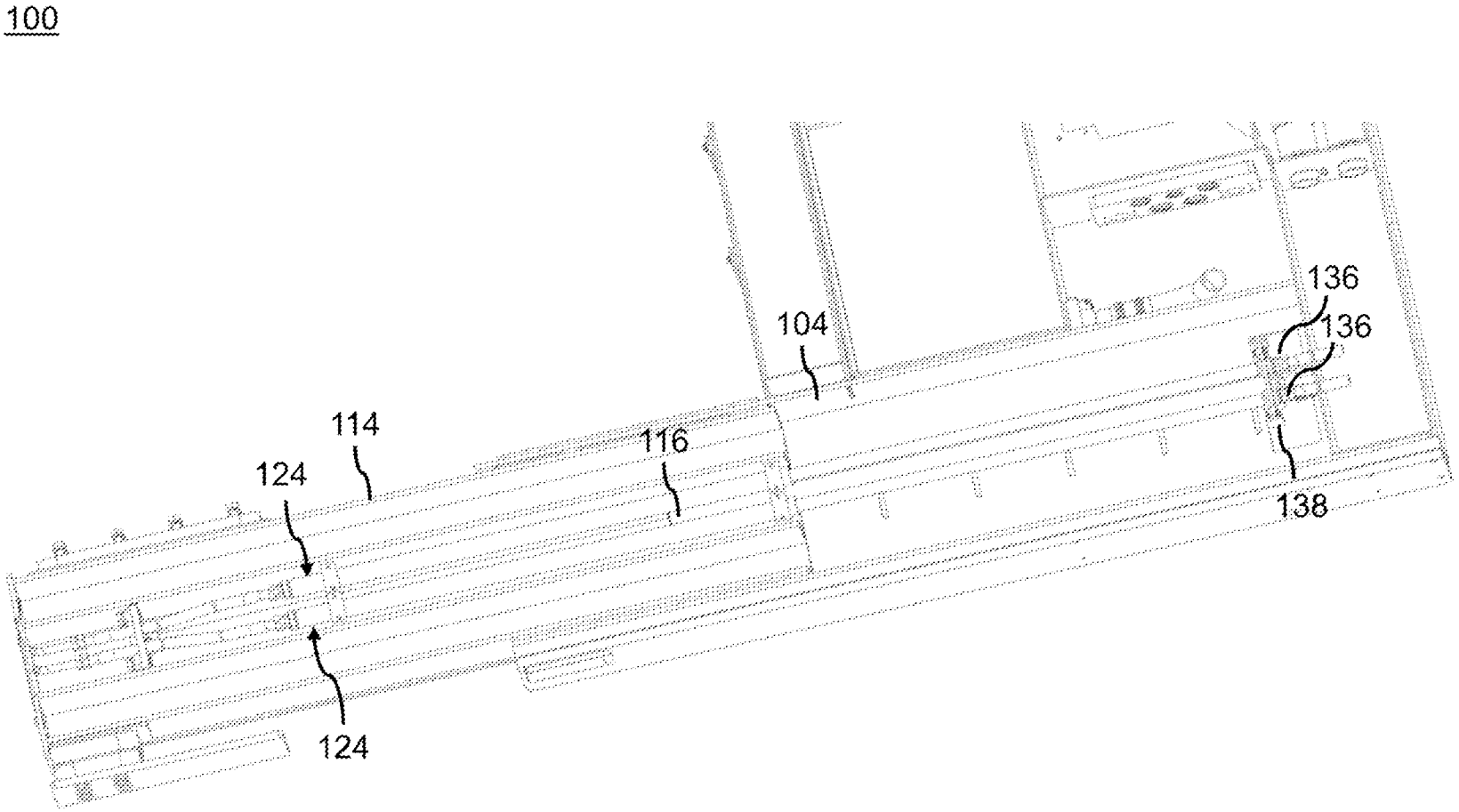

Referring now in particular to FIG. 1F-1H, the paving machine 100 may include one or more telescopic fluid lines 124. The telescopic fluid lines 124 (also referred to as flow tube, telescoping hydraulic fitting, and the like) may provide pressure lines and return lines for hydraulic fluid to and from the manifold assembly 120. The telescopic fluid line 124 may generally be provided in pairs, where a first telescopic fluid line **124*a* provides the pressure line (also referred to as a pressure path, supply line, and the like), and where the second telescopic fluid line 124*b* provides the return line (also referred to as return path, dump line, reservoir line, and the like). In this regard, the first telescopic fluid line 124*a* may provide a flow path between the hydraulic power supply 112 (e.g., from a pump) and the inlet manifold of the manifold assembly 118. The second telescopic fluid line 124*b* may provide a flow path between the outlet manifold of the manifold assembly 118 and the hydraulic power supply 112** (e.g., to the hydraulic reservoir).

Advantageously, the telescopic fluid lines 124 may provide such flow paths while the telescopic fluid lines 124 are disposed in a space within the frame 104 and the frame member 114 which would otherwise not be suitable for flexible hydraulic hoses. A first end of the telescopic fluid line 124 may be attached to the frame 104. A second end of the telescopic fluid line 124 may be attached to the frame member 114. In this regard, when the cylinder 116 causes the frame member 114 to telescope (e.g., retract or extend) relative to the frame 104, the telescopic fluid line 124 may telescope a similar amount. For example, FIG. 1G depicts the hydraulic cylinder 116 and the telescopic fluid line 124 in a compressed state, with no side-shift of the frame member 114. By way of another example, FIG. 1H depicts the hydraulic cylinder 116 and the telescopic fluid line 124 in a fully expanded state at a maximum stroke, with a full-length side-shift of the frame member 114. The hydraulic cylinder 116 and the telescopic fluid line 124 may be translated into a number of positions between the compressed state and the fully expanded state, based on a desired side-shift of the frame member 114. As may be understood, the length of the side-shift may be limited based on the stroke of the hydraulic cylinder 116 and the stroke of the telescopic fluid line 124.

The telescopic fluid line 124 may generally include two ports. The ports may provide a fluidic coupling between the telescopic fluid line 124 and a hydraulic pipe fitting 136. The hydraulic pipe fittings 136 may then fluidically couple the telescopic fluid line 124 with upstream and downstream components. The hydraulic pipe fittings 136 may also be coupled to or otherwise pass-through plate 134. Such plate 134 may also provide a mounting point for an end of the hydraulic cylinder 116.

Figure 2A:
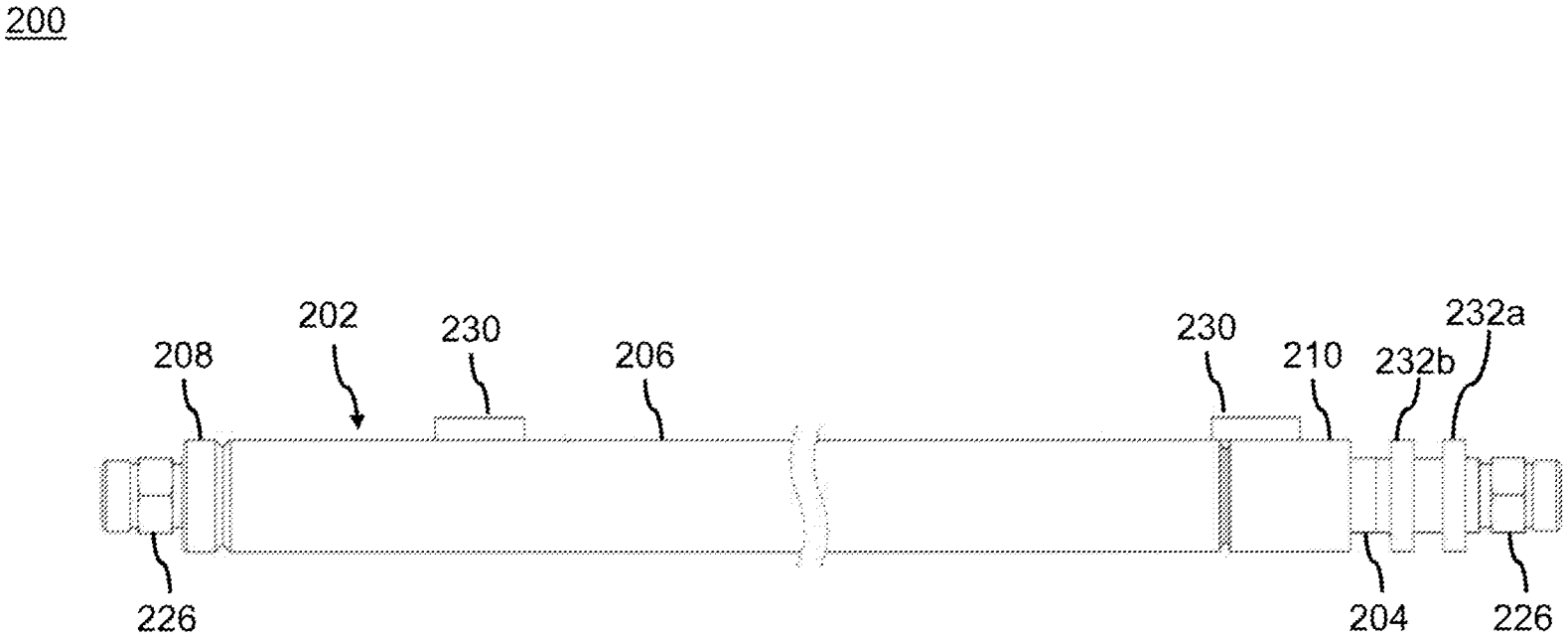
FIGS. 2A-2B depict a plan view of telescopic fluid line, in accordance with one or more embodiments of the present disclosure.
Figure 2B:
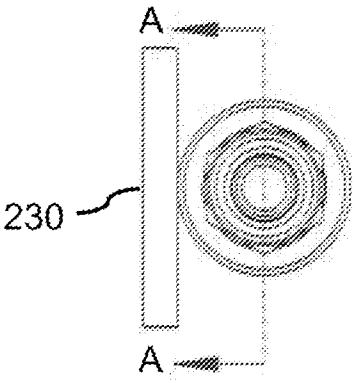
Figure 2C:
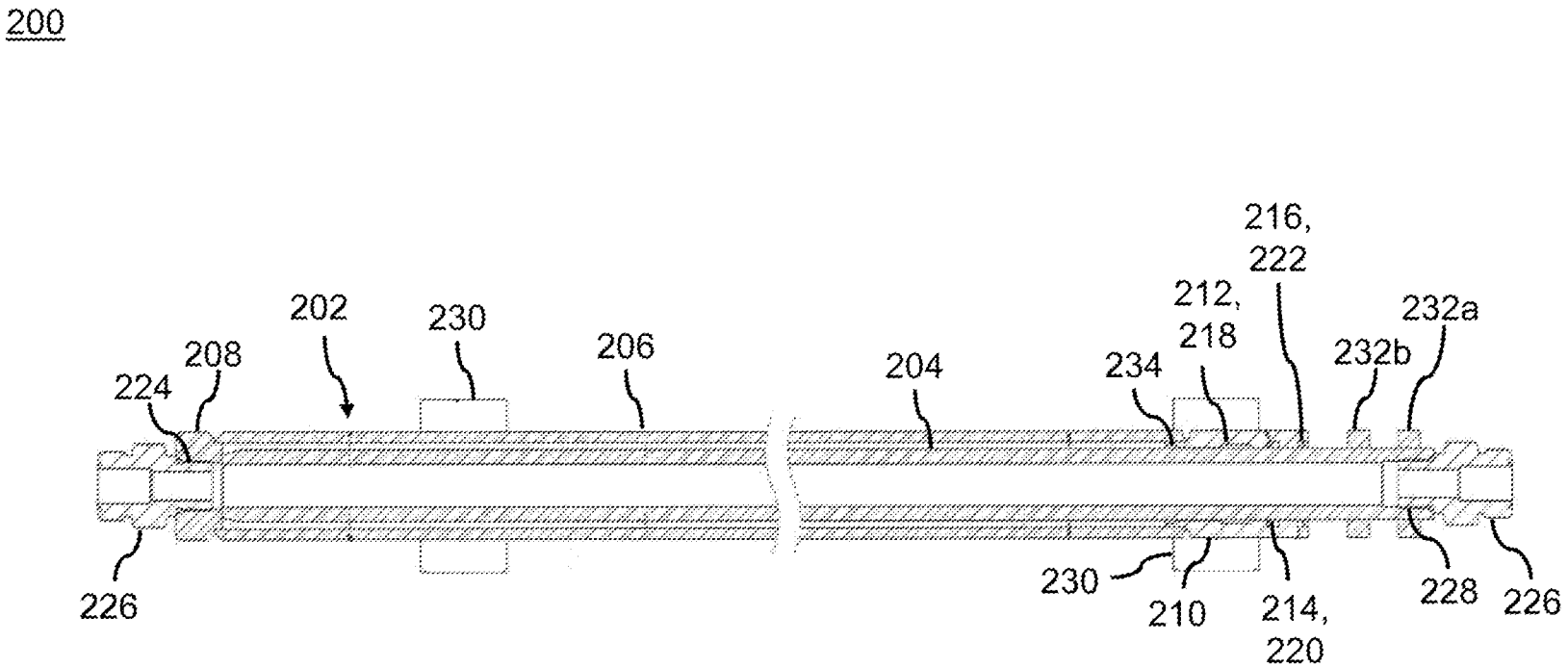
FIG. 2C depicts a cross-section view A-A of FIG. 2B, in accordance with one or more embodiments of the present disclosure.

Referring now to FIGS. 2A-2C, a telescopic fluid line 200 is described, in accordance with one or more embodiments of the present disclosure. The telescopic fluid line 200 may be similar to the telescopic fluid line 124. The telescopic fluid line 200 may include a number of components, such as, but not limited to, a case weldment 202, an inner pipe 204 (also referred to as a second pipe), and a number of hydraulic seals. The case weldment 202 may further include, but is not limited to, an outer pipe 206 (also referred to as a first pipe), a cap member 208, and a cap member 210.

The outer pipe 206 may include a first end and a second end. The outer pipe 206 may also include a cylindrical bore (also referred to as an inner diameter) defined by the wall of the pipe and disposed between the ends of the outer pipe 206. By the cylindrical bore, the outer pipe 206 may be configured to carry a flow of hydraulic fluid.

The cap member 208 and the cap member 210 may each be coupled to an end of the outer pipe 206. The cap member 208 and the cap member 210 may be coupled to the ends of the outer pipe 206 in any suitable fashion, such as, but not limited to, a weld or a threaded coupling 234. For example, the cap member 208 may be welded to the outer pipe 206. By welding the cap member 208 to the outer pipe 206, a relatively high strength coupling may be formed. By way of another example, the cap member 210 may be coupled to the outer pipe 206 by a threaded coupling. The threaded coupling may provide an ability to detach the cap member 210 from the outer pipe 206. The ability to detach the cap member 210 from the outer pipe 206 may be advantageous in servicing various seals housed within the cap member 210.

Furthermore, the cap member 208 may include a port 224 for interfacing with a hydraulic pipe fitting 226 (e.g., hydraulic pipe fitting 136) and transferring fluid by way of the cylindrical bore. The cap member 208 may act as a reducer for the outer pipe 206. In some instances, the port 224 of the cap member 208 is coaxial with the cylindrical bore of the outer pipe 206 for forming a linear flow path through the case weldment 202. It is further contemplated that the port 224 of the cap member 208 may be set orthogonal to the cylindrical bore of the outer pipe 206.

The case weldment 202 may further include one or more mounting brackets 230. By the mounting brackets 230, the case weldment 202 may be coupled to the frame member 114 (see FIG. 1G-1H, for example) or the frame 104. It is contemplated that by coupling the mounting bracket 230 to the frame member 114 (as opposed to the frame 104), a likelihood of the inner pipe 204 buckling may be reduced. Although the case weldment 202 has been described as including one or more mounting brackets 230, this is not intended as a limitation on the present disclosure. In some embodiments, the cap member 208 or the cap member 210 may include a mount including one or more bolt holes for coupling the case weldment 202 to a frame member of a paving machine. For example, the mount may include, but is not limited to, a plate mount (e.g., a square or rectangular flange), a foot mount, or an end lug mount. As may be understood, the mounts must be oriented to prevent interference with the hydraulic flow path.

The cap member 210 may also include a cylindrical bore defined by the walls of the cap member 210. The inner pipe 204 may thus be received within a portion of the outer pipe 206 and the cap member 210, by the cylindrical bores. In this regard, an outer diameter of the inner pipe 204 may include a clearance fit with the inner diameter of the outer pipe 206 and the cap member 210.

The cap member 210 may further include a number of recesses. The recesses may be configured to receive a number of seals. For example, the cap member 210 may include, but is not limited to, a recess 212, a recess 214, and a recess 216. The recess 216 may be disposed near an end of the cap member 210. The recess 214 may be disposed inwards of the recess 216, between the recess 212 and the recess 216. For example, the recesses may be arranged in a similar manner to the U.S. Pat. No. 6,450,048, titled HYDRAULIC CYLINDER MONITORING APPARATUS, which is incorporated herein by reference. In this regard, the recess 212 may be configured to receive a wear ring 218, the recess 214 may be configured to receive a rod seal 220, and the recess 214 may be configured to receive a rod wiper 222. The wear ring 218 may be provided to reduce a wear on the inner pipe 204 and the outer pipe 206. In this regard, wear ring 218 may include a sacrificial material with a hardness less than the hardness of the inner pipe 204 and the outer pipe 206, such as, but not limited to, an oil impregnated nylon or another material known in the art of wear rings. The rod seal 220 may surround the outer diameter of the inner pipe 204 to seal the hydraulic fluid between the cap member 210 and the inner pipe 204. The rod wiper 222 (also referred to as a canned wiper), may be configured to wipe hydraulic fluid from the inner pipe 204. In this regard, the rod wiper 222 may include any rod wiper known in the art of hydraulic cylinders, such as, but not limited to, a single lip wiper or a double lip wiper.

The inner pipe 204 may also be received within one or more portions of the case weldment 202, for translating relative to the case weldment, thereby providing the telescopic action. The inner pipe 204 may also include a cylindrical bore defined by the walls of the inner pipe 204. The cylindrical bore may be configured to carry the flow of hydraulic fluid. In some embodiments, the inner pipe 204 includes a port 228. By the port 228, the pipe 204 may be configured to couple with a hydraulic fitting 226. It is further contemplated that the inner pipe 204 may include a cap member (not depicted), including the port 228. However, the cap member of the inner pipe 204 may not be required, such as when there is no reduction or expansion in fitting diameter.

Thus, the inner pipe 204 may translate within and relative to the case weldment 202 for providing an adjustable length flow path for the hydraulic fluid between the port 224 and the port 228 by way of the inner pipe 204 and the outer pipe 206. The telescopic fluid line 200 may be provided with a stroke. The stroke of the telescopic fluid line 200 may be based on a length of the inner pipe 204 and similarly a length of the outer pipe 206. Such lengths may define a distance by which the inner pipe 204 may telescope relative to the case weldment 202 while remaining hydraulically sealed by the rod seal 220. For example, the stroke of the telescopic fluid line 200 may be up to 48 inches, or more, depending upon the desired application.

In some instances, the port 228 of inner pipe 204 is coaxial with the cylindrical bore of the inner pipe 204, for forming a linear flow path through the inner pipe 204. It is further contemplated that the inner pipe 204 or the cap member (not depicted) of the inner pipe 204 may include a port which is orthogonal to the cylindrical bore of the inner pipe 204.

As may be understood, the port 224 and the port 228 may include any port known in the art, such as, but not limited to, an internal (also referred to as female) or external (also referred to as male) threaded portion for receiving a standardized size of the hydraulic pipe fitting 226 (e.g., National Pipe tapered fuel (NPTF), National Pipe straight mechanical (NPSM), British Standard Pipe (BSP), International Organization for Standardization (ISO), and the like).

The inner pipe 204 may also include one or more collars 232. The collar 232 may be provided for mounting the inner pipe 204 with a frame of a paving machine. For example, the inner pipe may include a first collar 232*a* and a second collar 232*b*. The first collar 232*a* may be disposed proximate to the port 228. The second collar 232*b* may be disposed inwards of the first collar 232*a* on the inner pipe 204. By the distance between the first collar 232*a* and the second collar 232*b*, a mounting bracket 138 (see FIG. 1G-1H) of the paving machine may be received. The collars 232 may be one or more of welded to the inner pipe 204 or bolted to the inner pipe. Although the inner pipe 204 has been described as including one or more collars 232, this is not intended as a limitation on the present disclosure. In some embodiments, the inner pipe 204 or the hydraulic fitting 226 may include a mount including one or more bolt holes for coupling the inner pipe to a frame of a paving machine. For example, the mount may include, but is not limited to, a plate mount (e.g., a square or rectangular flange), a foot mount, or an end lug mount. As may be understood, the mounts must be oriented to prevent interference with the hydraulic flow path. However, it is contemplated that the collars 232 may reduce a likelihood of the inner pipe 204 buckling under telescopic action.

Thus, the telescopic fluid line 200 does not include a piston. In this regard, the purpose of the telescopic fluid line 200 is not to provide extension or retraction to an external component, but rather to provide an extendable flow path for hydraulic fluid. It is contemplated that the telescopic fluid line 200 may provide some extension or retraction when transferring hydraulic fluid, due to parasitic loading in accordance with Pascal's principle. To prevent inadvertent extension or retraction from the parasitic loading, the telescopic fluid line 200 may be coupled to a frame and a frame member of a paving machine by the mounting bracket 230 and the collar 232. The desired telescopic action of the telescopic feed line 200 may then be provided when the frame member is translated relative to the frame.

By the translation of the inner pipe 204 within the case weldment 202, the telescopic feed line 200 may be considered a single stage telescopic feed line. Although the telescopic feed line 200 has been described as being single stage, this is not intended as a limitation of the present disclosure. It is contemplated that the telescopic feed line may be a multi-stage telescopic feed line (e.g., two or more stages). By the multi-stages a compacted length of the multi-stage telescopic feed line may be reduced, when comparing the multi-stage telescopic feed line with a single stage telescopic feed line which includes a similar extended length. However, the multi-stage telescopic feed line may also include a substantially larger outer diameter. Thus, there may be a tradeoff between contracted length and diameter when selecting the number of stages.

Figure 3A:
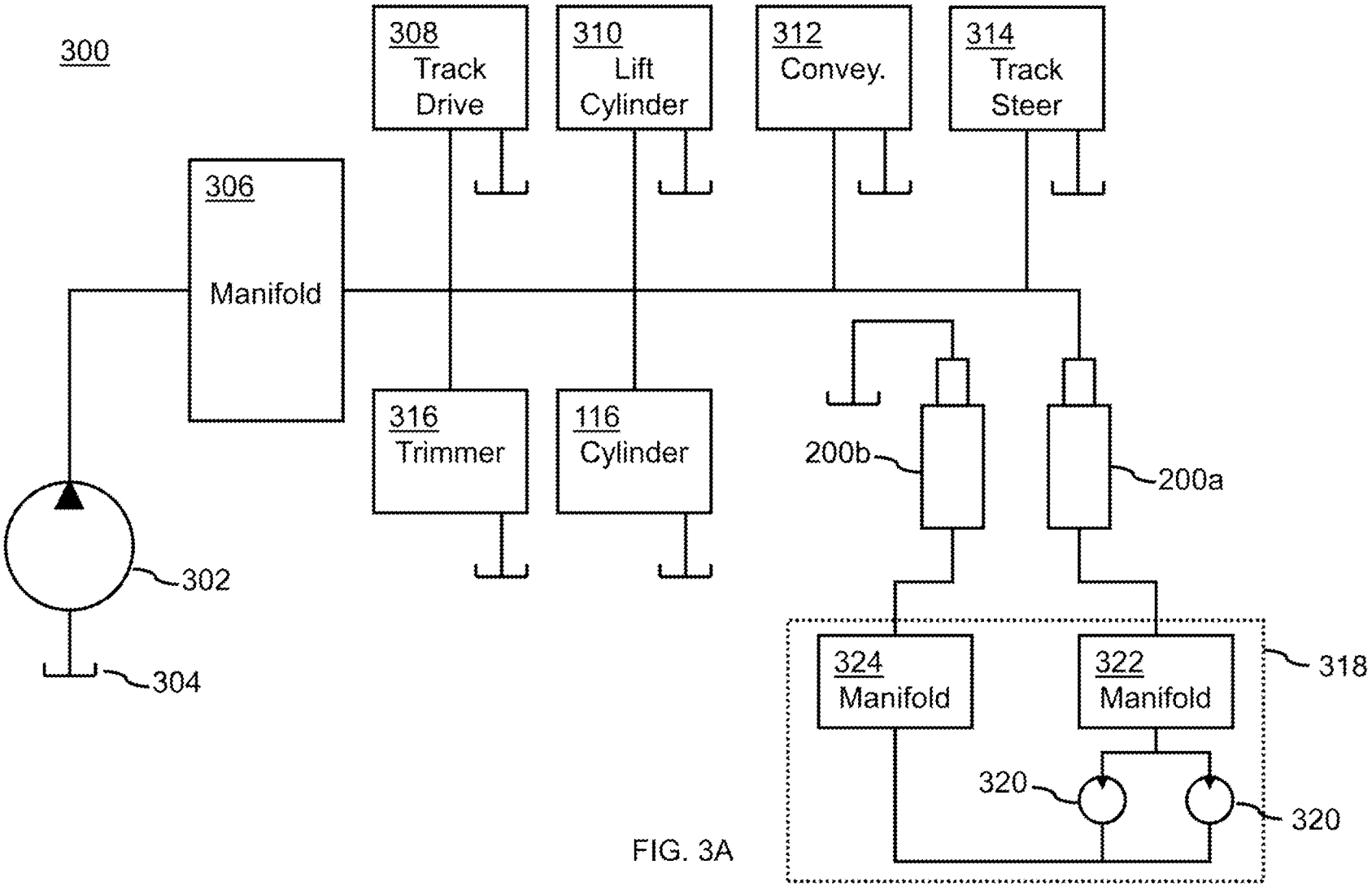
FIG. 3A depicts a simplified schematic diagram of a hydraulic circuit of a paving machine, in accordance with one or more embodiments of the present disclosure.
Figure 3B:
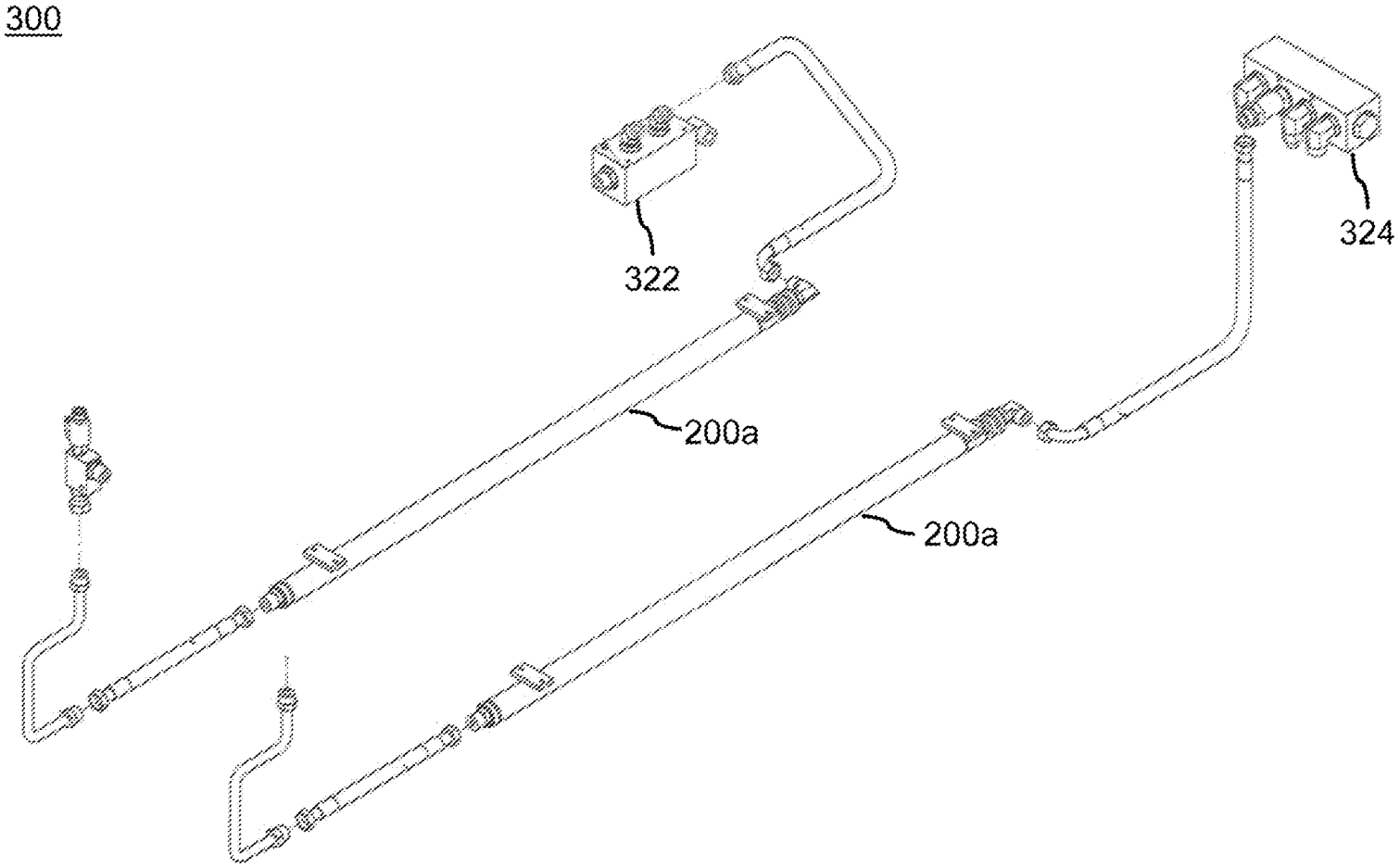
FIG. 3B depicts a partial perspective view of a hydraulic circuit of a paving machine, in accordance with one or more embodiments of the present disclosure.

Referring now to FIGS. 3A-3B, a hydraulic circuit 300 of the paving machine 100 is described, in accordance with one or more embodiments of the present disclosure. The hydraulic circuit may include a hydraulic pump 302 and a hydraulic reservoir 304 (also referred to as a hydraulic fluid reservoir) of the hydraulic power supply 112. The hydraulic pump 302 is connected to the hydraulic reservoir 304 and is configured to supply a flow of hydraulic fluid from the hydraulic reservoir 304. The hydraulic circuit 300 may also include a manifold 306 which diverts the flow of hydraulic fluid between a number of hydraulic sub-circuits, such as, but not limited to, a track drive sub-circuit 308, a lift cylinder sub-circuit 310, a conveyor sub-circuit 312, a track steer sub-circuit 314, a trimmer sub-circuit 316, and a vibrator sub-circuit 318.

The vibrator sub-circuit 318 may include a number of hydraulic motors 320 (e.g., between two and eight, or more). The hydraulic motors 320 may be configured to engage in response to receiving the flow of hydraulic fluid from the hydraulic power supply. The engagement of the hydraulic motors 320 may cause the vibrators of the paving machine 100 to vibrate, with the given vibrational frequency. In this regard, the flow rate may control the vibrational frequency.

The vibrator sub-circuit 312 may also include an inlet manifold 322. The inlet manifold 322 may be configured to control the flow of hydraulic fluid to the hydraulic motors 320. For example, the inlet manifold 322 may be electrically coupled to the manifold controller 120. The inlet manifold 322 may then receive electrical signals from the manifold controller 120 (e.g., based on a vibrator setpoint of the manifold controller 120), causing the inlet manifold 322 to control the flow to each of the hydraulic motors 320. The vibrator sub-circuit 312 may also include an outlet manifold 324. The outlet manifold 324 may combine the flow of hydraulic fluid from the hydraulic motors 329, for returning the hydraulic fluid to the hydraulic reservoir 304. As may be understood, the inlet manifold 322 and the outlet manifold 324 may be disposed within the manifold assembly 118.

In some embodiments, the hydraulic circuit 300 may include one or more of the telescopic fluid lines 200. As depicted in FIG. 3A-3B, the telescopic fluid lines 200 may provide a flow path to and from the vibrator sub-circuit. For example, a first telescopic fluid line 200*a* may provide a flow path between the hydraulic pump 302 (by way of the manifold 306 and various other components not depicted herein) and the inlet manifold 322. By way of another example, a second telescopic fluid line 200*b* may provide a flow path between the outlet manifold 324 and the hydraulic reservoir 304 (by way of various other components not depicted herein).

The hydraulic circuit 300 may also include the hydraulic cylinder 116 (see FIGS. 1F-1H). The hydraulic cylinder 116 may be in fluid communication with the hydraulic pump 302. The hydraulic cylinder 116 may be selectively controlled by the control system 108. For example, the hydraulic cylinder 116 may be a double acting cylinder, such that the extension and retraction may be controlled by selectively supplying fluid to either side of the cylinder. The telescopic fluid lines 200 may then telescope in response to the hydraulic cylinder 116 being fluidically engaged. In this regard, an extension or retraction of the hydraulic cylinder 116 may cause a similar extension or retraction of the telescopic fluid lines 200, due to both the hydraulic cylinder 116 and the telescopic fluid lines 200 being coupled to the frame 104 and the frame member 114.

As may be understood, the specific components of the various hydraulic sub-circuits and the paths to/from the hydraulic sub-circuits are not provided for clarity. It is further contemplated that one or more of the track drive sub-circuit 308, the lift cylinder sub-circuit 310, the conveyor sub-circuit 312, the track steer sub-circuit 314, or the trimmer sub-circuit 316 may include hydraulic components, such as, but not limited to, inlet manifolds, outlet manifolds, hydraulic motors, hydraulic cylinders, and the like. In some embodiments, one or more of the track drive sub-circuit 308, the lift cylinder sub-circuit 310, the conveyor sub-circuit 312, the track steer sub-circuit 314, or the trimmer sub-circuit 316 may include a flow path to the hydraulic pump 302 by way of one or more additional telescopic fluid lines (e.g., telescopic fluid lines 200) in a similar manner to the telescopic fluid lines 200*a*, 200*b*. The additional telescopic fluid lines may be advantageous for reducing hydraulic hose pinching and the like.

Figure 4:
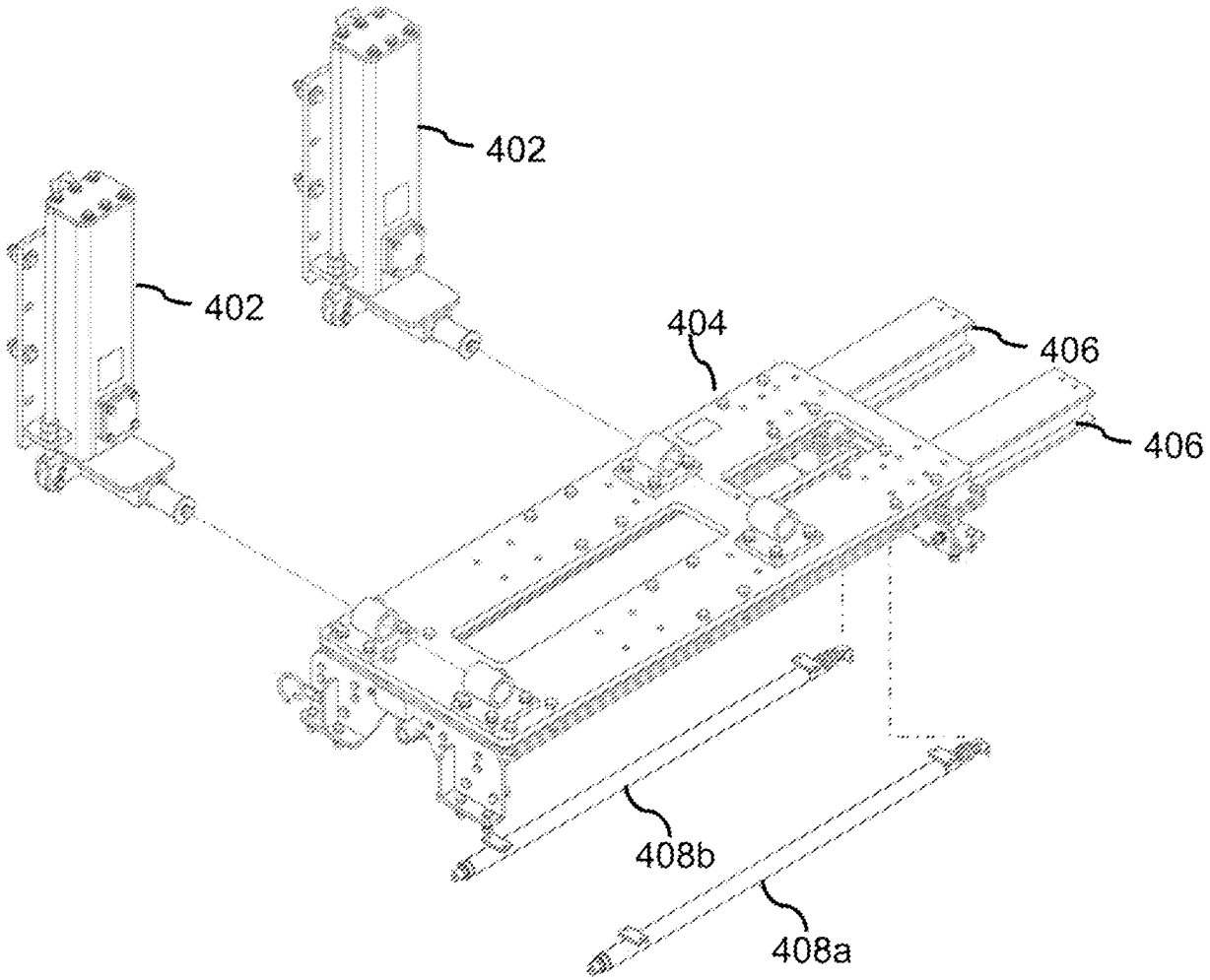
FIG. 4 depicts a trimmer mount assembly including telescopic hydraulic lines, in accordance with one or more embodiments of the present disclosure.

Referring now to FIG. 4, a trimmer mount assembly 400 is described, in accordance with one or more embodiments of the present disclosure. The trimmer mount assembly 400 may be configured to mount the trimmer sub-circuit 316 (and similarly the trimmer-head 140) to the paving machine 100. The trimmer mount assembly 400 may include a number of components, such as, but not limited to, vertical mount(s) 402, an adapter plate 404, and frame rails 406. The vertical mount(s) 402 may couple the trimmer mount assembly 400 to the frame 104. The vertical mount(s) 402 may also be coupled to the adapter plate 404. The frame rails 406 may then be configured to side-shift relative to the adapter plate 404 by one or more hydraulic cylinders (not depicted). By side-shifting the frame rails 406, the trimmer sub-circuit 316 may be similarly side-shifted (e.g., for side-shifting the trimmer-head of the paving machine 100).

Such trimmer-head 140 may include any trimmer-head known in the art. In this regard, the trimmer-head may include, but is not limited to, a trimmer wheel coupled to the hydraulic motor. The trimmer wheel may turn and trim a subgrade prior to paving.

The frame rail 406 may be configured to telescope relative to the adapter plate 404. The frame rail 406 may telescope relative to the adapter plate 404 by a hydraulic cylinder (in a similar manner to the hydraulic cylinder 116, the frame 104, and the frame member 114). One or more of the adapter plate 404 or the frame rail 406 may further include a component to reduce wear between the adapter plate 404 and the frame rail 406, such as, but not limited to, a wear pad or a roller bearing. By the telescopic action of the adapter plate 404 and the frame rail 406, a trimmer-head of the trimmer sub-circuit 316 coupled to the frame rails 406 may be side-shifted relative to the adapter plate 404 and similarly relative to frame 104 and the height adjustable leg assemblies 110. The ability to side-shift the trimmer-head 140 is advantageous in achieving a tight clearance between the height adjustable leg assemblies 110 (in particular the crawler tracks) of the paving machine and the surface being trimmed. The cylinder may include a suitable stroke, such as up to 36 inches or more.

In some embodiments, the trimer mount assembly 400 includes one or more of telescopic fluid lines 408. The telescopic fluid lines 408 may be similar to the telescopic fluid line 124 and the telescopic fluid line 200. A first end of the telescopic fluid line 408 may be coupled adapter plate 404 and a second end of the telescopic fluid line 200 may be coupled to one or more of the frame rails 406. Thus, when the frame rails 406 side-shift relative adapter plate 404, the telescopic fluid line 408 may telescope. For example, a first telescopic fluid line 408*a* may provide a flow path between the hydraulic power supply 112 (e.g., from a pump) and the trimmer sub-circuit 316 (e.g., a hydraulic motor controlling the trimmer-head). By way of another example, a second telescopic fluid line 408 may provide a flow path between the trimmer sub-circuit 316 and the hydraulic power supply (e.g., to the hydraulic reservoir).

Referring generally again to FIGS. 1A-4, the paving machine 100 is described.

It is contemplated that the telescopic fluid lines 124, 200, 408 may be utilized in a number of applications on the paving machine 100. For example, the telescopic fluid lines 124, 200, 408 may provide a flow path to hydraulic vibrators. By way of example, the telescopic fluid lines 124, 200, 408 may provide a flow path to trimmer-heads. By way of another example, the telescopic fluid lines 124, 200, 408 may provide a flow path to a slew drive or hydraulic steering cylinder of the height adjustable leg assembly 110. The telescopic fluid lines 124, 200, 408 may be provided in a number of orientations, such as horizontal or vertical, depending upon the application.

Furthermore, although the telescopic fluid lines 124, 200, 408 are described in use on paving machines, this is not intended as a limitation of the present disclosure. It is contemplated that a number of applications or machinery outside of the paving industry may benefit from the ability to provide an extendable flow path for hydraulic fluid.

One skilled in the art will recognize that the herein described components operations, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, operations, devices, and objects should not be taken as limiting.

As used herein, directional terms such as "top," "bottom," "front," "back," "over," "under," "upper," "upward," "lower," "down," and "downward" are intended to provide relative positions for purposes of description, and are not intended to designate an absolute frame of reference. Various modifications to the described embodiments will be apparent to those with skill in the art, and the general principles defined herein may be applied to other embodiments.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

From the above description, it is clear that the inventive concepts disclosed herein are well adapted to carry out the objectives and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

I claim:

1. A paving machine comprising:

a frame adapted to move in a paving direction, the frame including a hydraulic power supply coupled to the frame;

a frame member configured to telescope relative to the frame;

a slipform mold including a profile for forming a material into shape when the frame is moved in the paving direction, wherein the slipform mold is coupled to the frame member for side-shifting the slipform mold relative to the frame;

a plurality of vibrator motors configured to vibrate the material for consolidating the material, the plurality of vibrator motors being configured to vibrate in response to receiving a flow of hydraulic fluid from the hydraulic power supply; and a manifold assembly including a vibrator inlet manifold, a vibrator outlet manifold, and a manifold controller, the vibrator inlet manifold configured to control the flow of hydraulic fluid to the plurality of vibrator motors based on an electrical signal from the manifold controller, wherein the manifold assembly is coupled to the frame member for providing operator access to the manifold controller from the frame member.

2. The paving machine of claim 1, wherein the profile of the slipform mold is one of a curb including an integral gutter, a median barrier, a sidewalk, or a drainage canal.

3. The paving machine of claim 1, wherein the manifold assembly is coupled to an end of the frame member.

4. The paving machine of claim 1, further comprising a hydraulic cylinder coupled between the frame and the frame member for telescoping the frame member relative to the frame.

5. The paving machine of claim 4, further comprising:

a first telescopic fluid line providing a flow path between the hydraulic power supply and the vibrator inlet manifold; and a second telescopic fluid line providing a flow path between the vibrator outlet manifold and a hydraulic reservoir of the hydraulic power supply.

6. The paving machine of claim 5, wherein the first telescopic fluid line and the second telescopic fluid line are each received within at least a portion of the frame and within at least a portion of the frame member.

7. The paving machine of claim 5, wherein each of the first telescopic fluid line and the second telescopic fluid line include a single stage.

8. The paving machine of claim 5, wherein the first telescopic fluid line and the second telescopic fluid line each comprise:

a case weldment including:

a first pipe including a first end and a second end;

a first cap member coupled to the first end of the first pipe, the first cap member including a first port; and a second cap member coupled to the second end of the first pipe; and a second pipe including a second port.

9. The paving machine of claim 8, wherein the second pipe is received within the second cap member and within the first pipe by way of the second end; wherein the second pipe is configured to translate relative to the first pipe for providing an adjustable length flow path for the hydraulic fluid between the first port and the second port by way of the first pipe and the second pipe.

10. The paving machine of claim 9, wherein the second pipe includes a first collar and second collar coupling the second pipe to the frame, wherein the first collar is disposed proximate to the second port, wherein the second collar is disposed inwards of the first collar.

11. The paving machine of claim 10, wherein the first pipe includes at least one mounting bracket coupling the first pipe to the frame member.

12. The paving machine of claim 9, wherein the first port and the second port are coaxial.

13. The paving machine of claim 9, wherein the first cap member is coupled to the first end of the first pipe by a weld.

14. The paving machine of claim 13, wherein the second cap member is detachably coupled to the second end of the first pipe by a threaded coupling.

15. The paving machine of claim 9, wherein the second cap member includes a recess; wherein the first telescopic fluid line and the second telescopic fluid line further comprise a rod seal received within the recess of the second cap member; wherein the rod seal surrounds an outer diameter of the second pipe to seal the hydraulic fluid between the second cap member and the second pipe.

16. The paving machine of claim 15, wherein the recess of the second cap member is a first recess; wherein the second cap member includes a second recess and a third recess; wherein the first telescopic fluid line and the second telescopic fluid line further comprise a wear ring and a wiper; wherein the wear ring is received within the second recess; wherein the wiper is received within the third recess; wherein the first recess is disposed between the second recess and the third recess.

17. The paving machine of claim 9, wherein the first port includes a first threaded portion for receiving a first hydraulic fitting; wherein the second port each include a second threaded portion for receiving a second hydraulic fitting.

18. The paving machine of claim 1, comprising: a hydraulic circuit, wherein the hydraulic circuit comprises:

a hydraulic reservoir of the hydraulic power supply, wherein the hydraulic reservoir is configured to hold the hydraulic fluid;

a hydraulic pump of the hydraulic power supply, wherein the hydraulic pump is connected to the hydraulic reservoir; the hydraulic pump configured to supply the flow of the hydraulic fluid from the hydraulic reservoir;

a hydraulic subcircuit including:

the plurality of vibrator motors configured to engage in response to receiving the flow of hydraulic fluid from the hydraulic pump;

the vibrator inlet manifold; and the vibrator outlet manifold;

a first telescopic fluid line providing a flow path between the hydraulic pump and the inlet manifold; and a second telescopic fluid line providing a flow path between the outlet manifold and the hydraulic reservoir.

19. The paving machine of claim 18, further comprising a hydraulic cylinder in fluid communication with the hydraulic pump; wherein the first telescopic fluid line and the second telescopic fluid line telescope in response to the hydraulic cylinder being fluidically engaged.

20. The paving machine of claim 19, wherein each of the first telescopic fluid line, the second telescopic fluid line, and the hydraulic cylinder are coupled to the frame and the frame member of the paving machine; wherein the hydraulic cylinder is configured to telescope the frame member relative to the frame upon being fluidically engaged.

* * * * *